US006347516B1

(12) United States Patent
Bolz et al.

(10) Patent No.: US 6,347,516 B1
(45) Date of Patent: Feb. 19, 2002

(54) ELECTROHYDRAULIC PRESSURE SUPPLY UNIT WITH VARIABLE-DISPLACEMENT PUMP AND CONTROLLABLE ELECTRIC DEVICE

(75) Inventors: Gerald Bolz, Berlin; Michael Jürging, Mörfelden; Reinhard Orthmann, Mainz, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/607,963

(22) Filed: Jun. 30, 2000

(30) Foreign Application Priority Data

Jul. 2, 1999 (DE) ..... 199 30 648

(51) Int. Cl.[7] ..... F16D 31/02; F04B 49/08; F04B 49/20

(52) U.S. Cl. ..... 60/431; 60/434; 60/452; 417/43

(58) Field of Search ..... 60/431, 433, 434, 60/452, 479; 417/20, 43, 217, 218, 222.1

(56) References Cited

U.S. PATENT DOCUMENTS 5,638,677 A * 6/1997 Hosono et al. ..... 60/431

* cited by examiner

*Primary Examiner*—Edward K. Look
*Assistant Examiner*—Michael Leslie
(74) *Attorney, Agent, or Firm*—Venable; Norman N. Kunitz

(57) ABSTRACT

An electrohydraulic pressure supply unit involving the joint operation of two energy converters, which can be adjusted independent of each other, including an electric motor with speed control that drives a variable displacement pump with a variable displacement volume. The electric motor converts electrical output (loss-encumbered), into mechanical output, meaning into speed n and torque T. The pump then converts this mechanical output (also loss-encumbered) into hydraulic output. The hydraulic output is determined by the pressure difference Δp across the pump and the volume flow Q. The pressure difference Δp generally is impressed by the consumer or load on the system. The volume flow Q is the result of the displacement volume V and the motor speed n. The torque T, which must be generated by the motor, is derived from the displacement volume V and the pressure differential Δp. During the conversion from hydraulic output to mechanical output, the displacement volume V determines the distribution of the output to the speed n of the motor and the torque T. The current I flowing through the electric motor is primarily determined by the torque T while the voltage U is primarily influenced by the motor speed n. The volume flow supplied by the electrohydraulic pressure supply unit is essentially adjusted by controlling the speed adjustment of the electric motor. The speed of the electric drive motor in this case can essentially be adjusted independent of the displacement volume of the variable displacement pump.

11 Claims, 5 Drawing Sheets

ELECTROHYDRAULIC PRESSURE SUPPLY UNIT WITH VARIABLE-DISPLACEMENT PUMP AND CONTROLLABLE ELECTRIC DEVICE

CROSS REFERENCE TO RELATED APPLICATION

This application claims the priority of German patent Application No. 199306648.6-32 filed Jul. 2, 1999, which is incorporated herein by reference.

BACKGROUND OF THE INVENTION

The invention relates to an electrohydraulic pressure supply unit with a speed-controlled electric drive motor and a variable displacement pump that is coupled to and driven by the motor, and whose displacement volume can be changed with an adjustment member.

A plurality of uses has been discovered for the electrohydraulic pressure supply units. These units are used in electrohydraulic control devices, for the hydraulic lifting and lowering of loads, for the actuation of hydraulic servo components and, not last, in motor vehicle hydraulic systems. The electrohydraulic supply units, used for example in motor vehicle hydraulic systems, are used in power steerings and electrohydraulically actuated actuators. Until now, three different principles were used to control the volume flow delivered by the hydraulic pump.

According to one known control principle, the hydraulic output of a hydraulic pump driven by an electric motor is adjusted by controlling the speed of the electric motor. With systems of this type, the electric motor is operatively connected to the hydraulic pump and the volume flow delivered by the hydraulic pump depends on the speed of the electric drive motor. In addition to the drive speed, the hydraulic pump itself is not provided with any other systems for controlling the delivered volume flow. The electric drive motor therefore must meet extremely high requirements for the layout of these systems. The drive motor must be able to process high volume flows with small system pressures on the load side, as well as small volume flows with high system pressures on the load side. The delivered volume flow is proportional to the speed of the drive motor while the system pressure on the load-side is proportional to the torque generated by the motor. As a result, the drive motors of these electrohydraulic systems must be designed for high speed as well as a high torque, thus resulting in very involved and expensive electric drive motors.

For that reason, electrohydraulic systems have been proposed, for which the electric drive is operated with a constant speed, thus permitting an optimization of the electric motor toward a single speed. Owing to the fact that the electric motor is the most expensive component of an electrohydraulic system, cost advantages can be achieved if the electric motor is optimized toward a constant speed. The required volume flow of the hydraulic pump is adjusted by regulating a by-pass valve. This control principle presupposes that the pump constantly supplies at least the desired volume flow. Since the desired volume flow must also be made available if no hydraulic output is required, these systems have a relatively high, unused dissipation.

In particular in motor vehicles, the power that can be supplied by the vehicle electrical system for the electric drive of a pump is limited. That is the reason why mechanical drives are used for hydraulic pumps with a higher output, which are connected to the motor vehicle internal combustion engine, for example, by way of a belt drive or chain drive. The driving speed of the pump is thus coupled with the speed of the internal combustion engine and cannot be adjusted independently. The delivered volume flow of those systems is controlled through adjusting the motor displacement volume of the connected hydraulic pump. The system pressure controls the pump displacement volume in dependence on a reference pressure. These systems have the disadvantage that the delivered volume flow depends on the speed of the internal combustion engine. Since the necessary system pressure must also be made available at lower speeds of the internal combustion engine, pumps with relatively high maximum displacement volume must be used for these systems. However, the displacement volume should be adjustable to the smallest possible value for high speeds of the internal combustion engine because otherwise the system pressure would rise to unfavorably high values. Thus, the displacement volume of the pump must be adjustable over a relatively wide range for these systems, which results in large mechanical designs for the variable displacement pumps.

The object according to the invention is to provide an electrohydraulic pressure supply unit with variable displacement pump and controllable drive, which simultaneously permits the optimization of the electric drive as well as the optimization of the variable displacement pump with respect to minimizing the necessary component sizes.

SUMMARY OF THE INVENTION

This object according to the present invention by an electrohydraulic pressure supply unit which comprises: a speed-controlled electric drive motor; a variable displacement pump, for which the displacement volume (V) can be changed with an adjustment member, and having connecting lines and load connections; a device for determining the delivered volume flow ($Q_{actual}$) of the pump; a regulating device for regulating the drive motor speed, with the input variables provided to the regulating device including at least the delivered volume flow ($Q_{actual}$) and a desired volume flow ($Q_{desired}$); a pump adjustment unit for actuating the adjustment member of the variable displacement pump; a pressure gauge for determining the differential pressure ($\Delta p$) across the load connections, and, a control unit for actuating the pump adjustment device, with the control unit using at least one reference pressure ($p_{ref}$) and the differential pressure ($\Delta p$) as input variables.

The invention involves the joint operation of two energy converters that can be adjusted separately including an electric motor with speed control, which drives a variable displacement pump, and a variable displacement pump with variable displacement volume. The electric motor converts electrical output, consisting of voltage U and current I (loss-encumbered), into mechanical output, meaning into speed n and torque T. The pump converts (also loss-encumbered) this mechanical output of the motor into hydraulic output. The hydraulic output is determined by the pressure difference $\Delta p$ across the pump and the volume flow Q. As a rule, the pressure difference $\Delta p$ is impressed by the user onto the system. The volume flow Q is derived from the displacement volume and the motor speed n. The torque T, which must be generated by the motor, is derived from the displacement volume V and the pressure difference $\Delta p$. During the conversion from hydraulic output to mechanical output, the displacement volume V determines the distribution of the output to the speed n of the motor and the torque T. The current I flowing through the electric motor is primarily determined by the torque T while the voltage U is primarily influenced by the motor speed n. Structural size and electrical dissipation in the electric motor are primarily determined by the maximum torque T to be provided by the motor, meaning it is determined by the current I. The delivered volume flow for the electrohydraulic pressure supply is essentially adjusted via the speed adjustment of the controlled electric motor. The speed of the electric drive motor for the most part can be adjusted independently of the displacement volume of the variable displacement pump. For the most part independently means that only the respectively predetermined, desired volume flows and reference pressures that are required at the current time must be taken into account for adjusting the speed and the displacement volume. Within the range of these two specified system values, the drive motor speed can be adjusted completely independently of the displacement volume of the variable displacement pump. As a result, the displacement volume adjustment of the variable displacement pump can be pressure-controlled and the pump output, which is changed due to the displacement volume adjustment, can be compensated by the independent speed control of the electric motor. The volume flow can be detected either directly via a volume-flow meter or indirectly from the reaction of the machine tool, e.g., from the regulating distance of the connected actuator. The variable displacement pump can thus be operated as a device for influencing the torque, e.g., as a torque regulator for the electric motor.

The following advantages are primarily achieved with the invention:

The pressure difference $\Delta p$ and the volume flow Q determine the hydraulic output. The volume flow Q is influenced by the speed n of the motor and the displacement volume V of the variable displacement pump. According to the invention, the combination of a speed-adjustable drive motor with a variable displacement pump with variable displacement volume V thus provides two degrees of freedom for influencing the hydraulic output. As a result, it is advantageously possible to adjust the power consumption of the electric motor to the respectively required hydraulic output. The destruction of delivered output in by-pass lines is thus advantageously avoided.

A further advantage of the combination according to the invention can be seen in that the necessary differential pressure $\Delta p$ can be supplied for the most part independent of the torque T of the electric motor. The speed n together with the adjusted displacement volume V of the variable displacement pump also influences the differential pressure $\Delta p$. This fact is used advantageously for limiting the maximum torque T, which must be provided by the electric motor. It is even more advantageous if an electric motor with high speed and small torque is operated to supply the same output as an electric motor with low speed and high torque. With motors, the torque determines the structural size and thus the costs for the system. Using the variable displacement pump as a device for influencing the torque, e.g., as a torque regulator, advantageously permits limiting the torque, thus making it possible to have an optimum, low-loss operation with a smaller drive motor.

Another advantage of the combination according to the invention of a speed-controlled drive and a variable displacement pump with variable displacement volume is that an electrohydraulic pressure supply unit of this type can generate high pressure differences $\Delta p$ for small volume flows Q, as well as high volume flows Q with small pressure differences $\Delta p$ while the power consumption remains the same. Examples for such operating states, are on the one hand, highly dynamic adjustment movements and, on the other hand, holding functions under load. Operating states of this type occur in motor vehicles, for example, with activated running gears, electrohydraulic brakes and steering mechanisms. Electrohydraulic actuators for these systems can be operated more economically with the pressure supply unit according to the invention and can have a smaller, lighter and more cost-effective design.

Using the electrohydraulic pressure supply unit according to the invention in motor vehicles results in another advantage. The previously described option of limiting the torque has advantageous effects on the electronic control and power equipment. The torque T of the electric motor is essentially proportional to the current I. Thus, if the torque is limited, the current I is also limited. As a result, the electronic control and power equipment can also be designed for smaller current intensities. Owing to the fact that losses in the electronic control and power equipment are also primarily determined by the current intensity, the pressure supply unit according to the invention also permits an optimum design as well as the low-loss operation of the electronic control and power equipment.

Exemplary embodiments of the invention are shown and explained further below with the aid of drawings.:

DETAILED DESCRIPTION OF THE PREFERRED EMBODIMENTS

Figure 1:
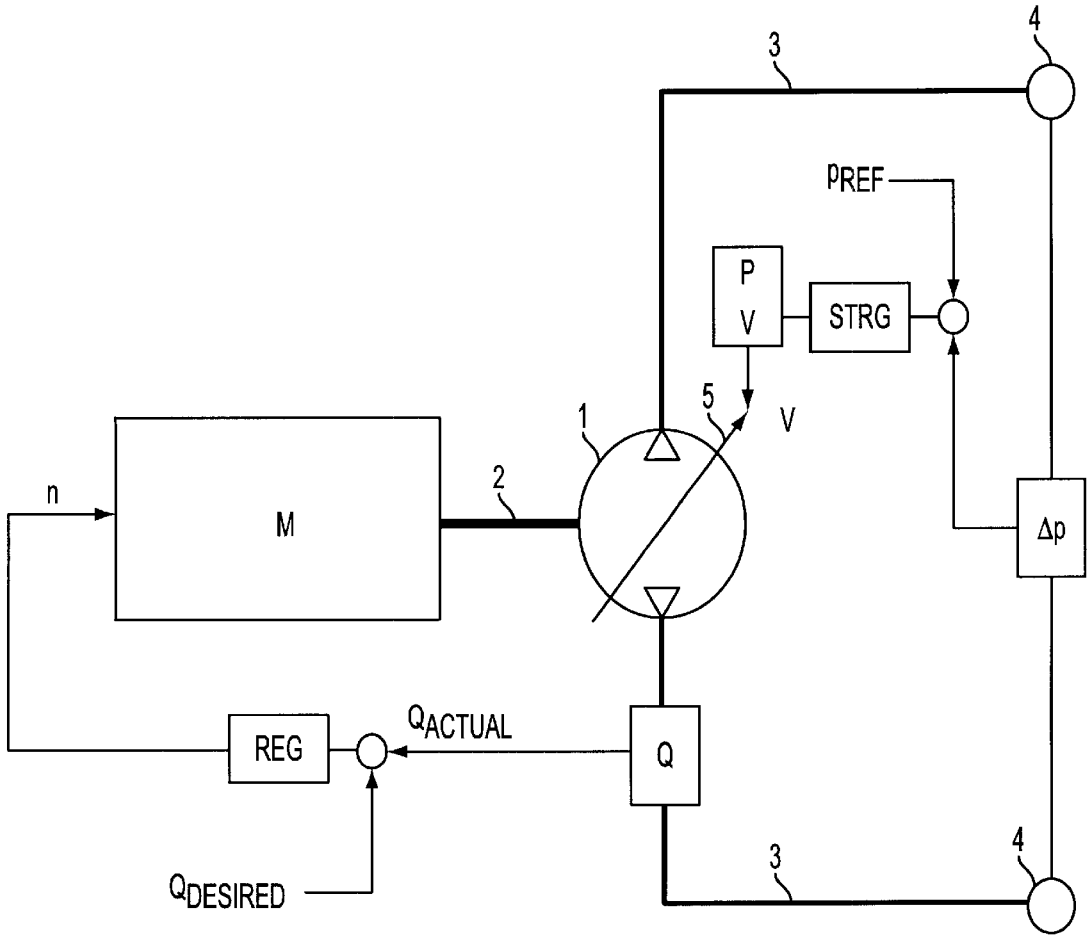
FIG. 1 is a schematic representation of an electrohydraulic pressure supply unit according to the invention.

In the Figures the same reference numerals are used to represent the same elements in all figures.

FIG. 1 shows a schematic representation of an electrohydraulic pressure supply unit according to the invention. An electric motor M as drive motor is operatively connected to a variable displacement pump 1. The speed n of electric motor M can be adjusted with a regulating device Reg. A change in the speed of the electric motor is transmitted via the operative connection 2 to the variable displacement pump 1. The regulating device Reg processes as input values a predetermined value $Q_{des}$ for the necessary desired volume flow and a measured value $Q_{actual}$ for the actually delivered volume flow of the variable displacement pump 1. The actual volume flow $Q_{actual}$ is determined with the aid of a device Q for determining the delivered volume flow. The actual volume flow can be determined directly with a volume flow sensor or indirectly from the reaction of the connected machine tool. The connecting lines 3 end in the consumer or load connections 4. One or several hydraulic actuators and one or several hydraulic reservoirs can be connected on the system side to the consumer or load connections 4. FIGS. 2 to 9 show exemplary embodiments for connecting an actuator.

The differential pressure Δp is recorded with the aid of a pressure gauge between the connections 4, that is to say between the output line and the intake line of the variable displacement pump 1. The differential pressure Δp controls the displacement volume V of the variable displacement pump 1, in dependence on a reference pressure $p_{ref}$. For this, the differential pressure Δp and the reference pressure $p_{ref}$ are fed to a control unit Strg. The control unit Strg controls the pump adjustment PV, which is operatively connected to the adjustment member 5 of the variable displacement pump 1. A change in the displacement volume influences the delivered volume flow Q. By way of the speed n, the regulating device Reg adjusts the delivered volume flow $Q_{actual}$ to the required volume flow $Q_{desired}$. As an alternative to the direct measurement, the volume flow can also be detected by determining the regulating distance or movement of the adjustment member 5 and the operating speed of the variable displacement pump 1, for example, the speed n. Below a limiting moment that is fixed by the value $p_{ref}$, the pump 1 operates like a constant unit with maximum displacement volume. The variation of the electric motor speed n modulates the volume flow (including reversal). If the limiting moment is exceeded, the regulating device Reg reduces the displacement volume until the limiting moment is present as the load moment. The torque is measured indirectly via the motor current or the differential pressure Δp. If the displacement volume is reduced, the required volume flow $Q_{desired}$ is made available through an increase in the motor speed.

Figure 2:
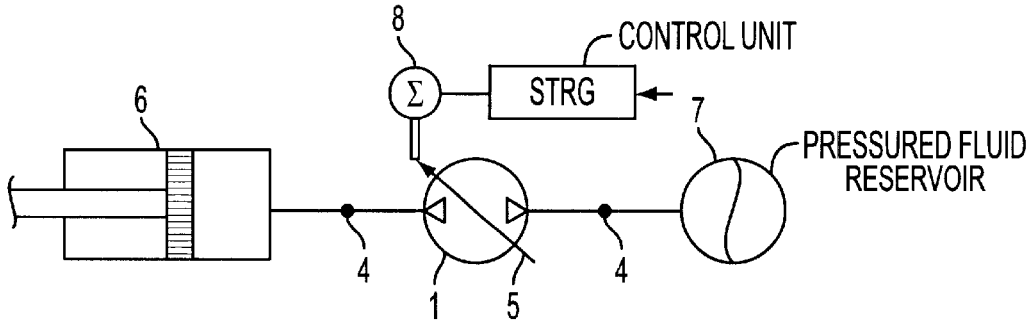
FIG. 2 is a block diagram of an exemplary embodiment of a pump adjustment device for use in the basic supply unit according to the invention for reversible pressure supply systems, in which the pump is adjusted with an electric actuator.

FIG. 2 shows a basic diagram of an exemplary embodiment of the pump adjustment device according to the invention for reversible systems, for which the pump is adjusted with an electric actuator. A hydraulic actuator 6 and a pressure reservoir 7 are connected to the pump connections 4. The adjustment member 5 for the variable displacement pump 1 is actuated with an electric actuator 8, which is actuated by the control unit Strg.

Figure 3:
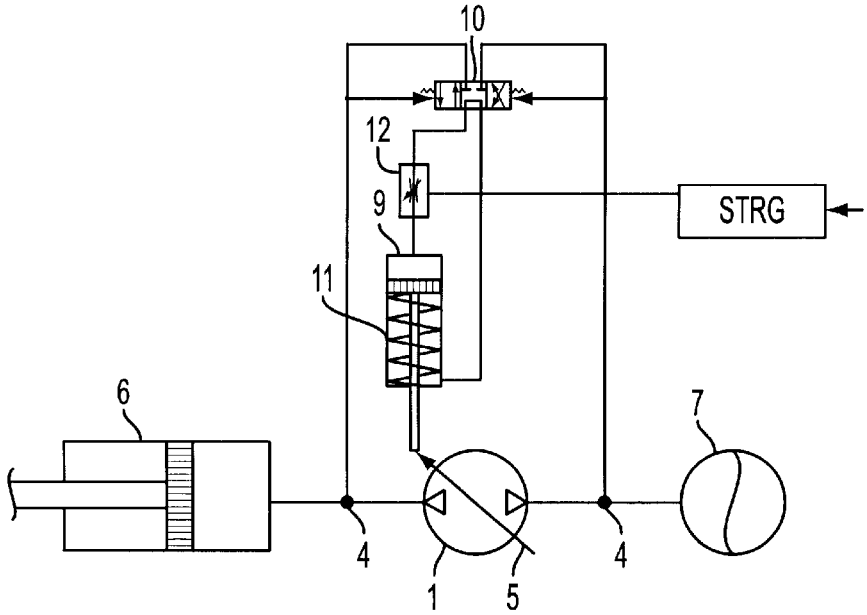
FIG. 3 is a block diagram of an exemplary embodiment of a pump adjustment device for use in the basic supply unit according to the invention for reversible systems, in which the pump is adjusted with a control piston with a pressure-regulating valve.

FIG. 3 shows a basic diagram of an exemplary further embodiment according to the invention for reversible systems, in which the pump 1 is adjusted with a control piston with a pressure regulating valve. In this exemplary embodiment, a control piston 9 changes the position of the adjustment member 5 of pump 1. The control piston 9 is always connected to the pressure side of the pump, which is ensured by a pressure-controlled 4/3-way valve 10 whose position is controlled by the pressure at the load connection 4. A spring 11 pivots the adjustment member 5 to maximum displacement volume if the pressure is 0, and under pressure delivers a distance-proportional counter force. The piston power of control piston 9 can be adjusted via an electrically controlled valve 12 for regulating the pressure, e.g., a pressure-regulating valve, if pressure is admitted to the control piston 9. The valve 12 for regulating the pressure is controlled by the control unit Strg. The spring force of piston spring 11 determines a piston position.

Figure 4:
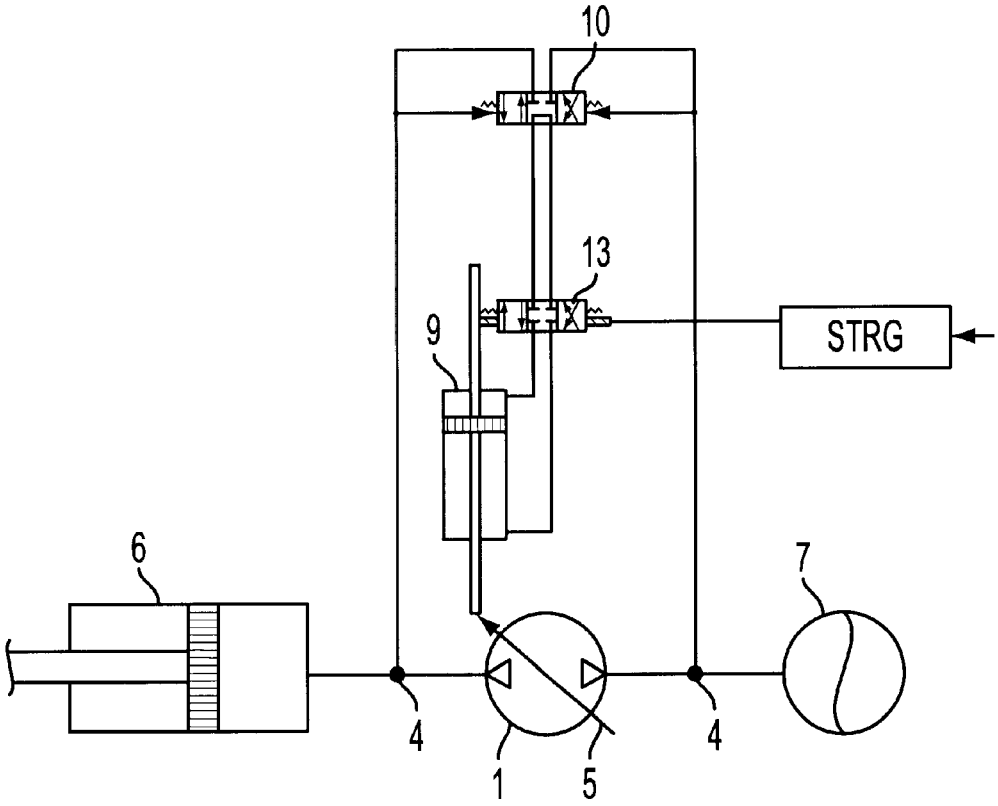
FIG. 4 is a block diagram of an exemplary embodiment according to the invention for reversible systems, for which the pump is adjusted with a control piston and an electrically actuated 4/3-way valve.

FIG. 4 contains a basic diagram of a further exemplary embodiment according to the invention of reversible systems, for which the pump 1 is adjusted with a control piston and an electrically actuated 4/3-way valve 13. In this exemplary embodiment, a differential control piston 9 changes the position of adjustment member 5 of pump 1. An electrically controlled 4/3-way valve 13 ensures that the desired respective piston surface of the differential control piston 9 is provided with pressure. The opening time of the 4/3-way valve 13 controls the piston position. The center position of the valve 13 blocks the oil or hydraulic fluid flow to the piston 9 and fixes the piston 9 in its position. The valve 13 is controlled via the control unit Strg. A pressure-controlled 4/3-way valve 10 ensures the direction of the control pressure gradient. The dynamic of the adjustment depends on the level of the pressure gradient.

Figure 5:
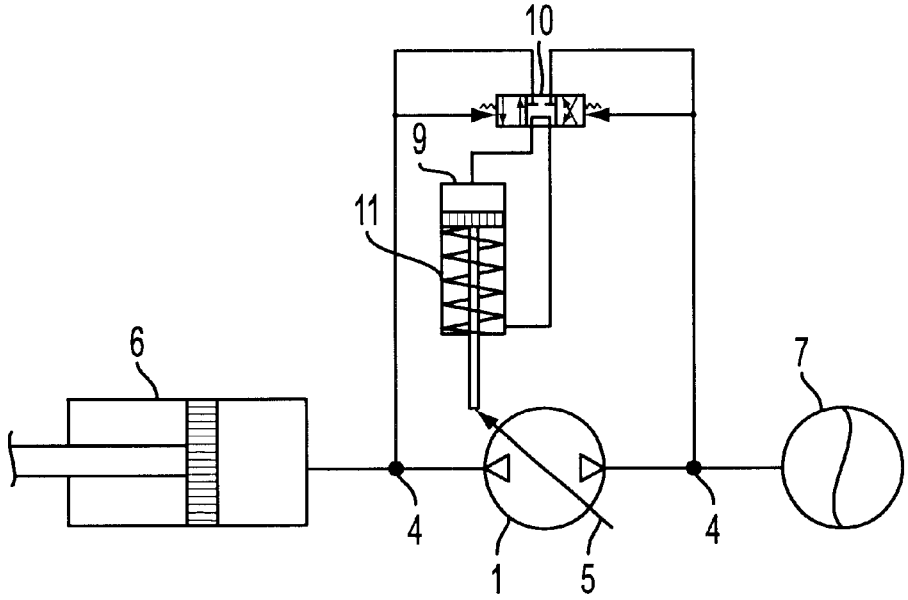
FIG. 5 is a block diagram of an exemplary embodiment according to the invention for reversible systems, for which the pump is adjusted with a system-pressure admitted control piston with spring.

FIG. 5 contains a basic diagram of still another exemplary embodiment according to the invention if the pump adjustment device PV for reversible systems, for which the pump 1 is adjusted with a system-pressure admitted control piston with a spring. In this exemplary embodiment, a control piston 9 changes the position of adjustment member 5 of pump 1. The control piston 9 is always connected to the pressure side via the connections 4 and the 4/3-way valve 10. A spring 11 moves the adjustment member 5 to maximum displacement volume if the pressure is 0 and delivers under pressure a distance-proportional counter force. The movement distance for the displacement piston is proportional to the existing pressure gradient. If the spring 11 is installed with pre-stressing, the system does not exert any control until the limit pressure gradient $p_{ref}$ is exceeded. The limit pressure gradient $p_{ref}$ is predetermined by the pre-stressing of spring 11. The parallel installation of springs 11 with different lengths and/or different rigidity or the use of differential pistons changes the control characteristic of the control piston 9. Since the load moment is approximately proportional to the pressure, the differential pressure Δp between the two connections 4 can be used as a control variable. The advantage of this embodiment lies in its passive self-regulation through spring 11. An active regulation of the control piston 9 through an active control can be dispensed with.

Figure 6:
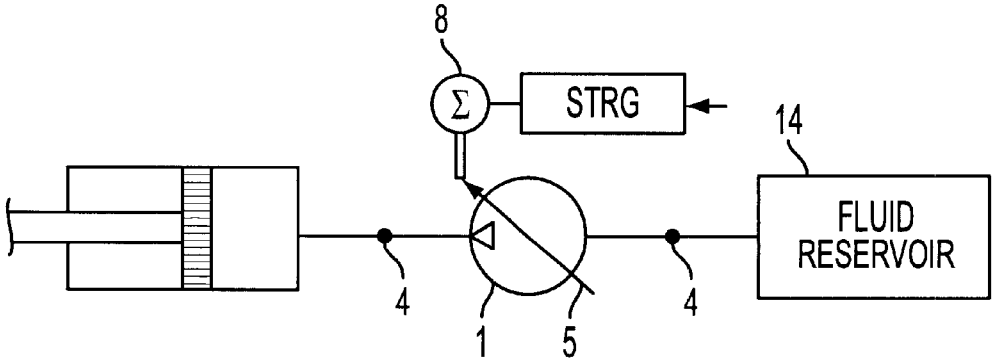
FIG. 6 is a block diagram of an exemplary embodiment according to the invention for non-reversible systems, for which the pump is adjusted with an electric actuator.

FIG. 6 contains a basic diagram of an exemplary embodiment according to the invention of an adjustment device PV for a non-reversible system, for which the pump is adjusted with an electric actuator. In contrast to the exemplary embodiment according to FIG. 2, the pump 1 is not reversible in this exemplary embodiment. Another difference to FIG. 2 is that the reservoir 14 is not a pressure reservoir, but simply a non-pressurized reservoir for hydraulic fluid for actuating the hydraulic actuator 6. The electric actuator 8 activates the adjustment member 5 of pump 1 while the control unit Strg controls the actuator 8.

Figure 7:
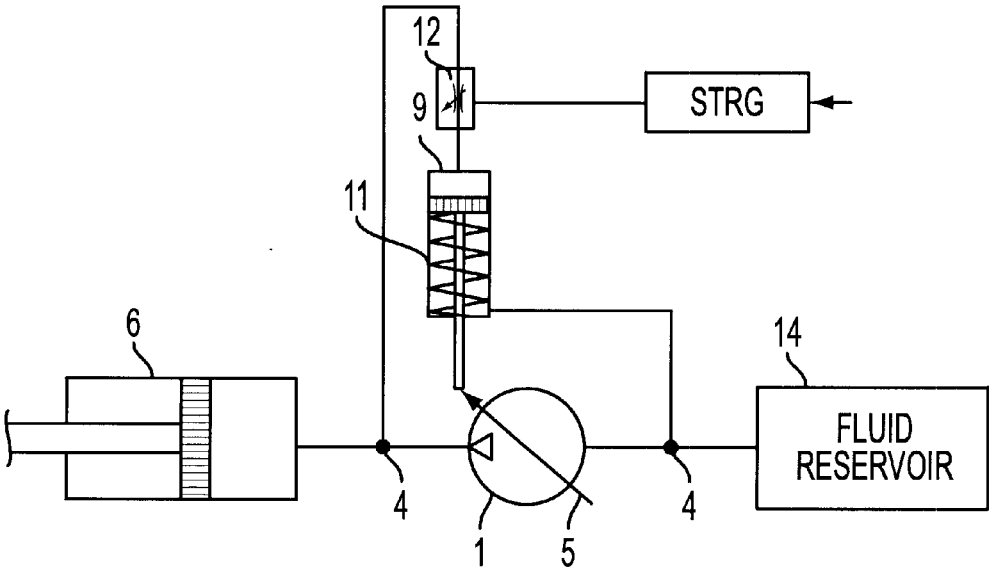
FIG. 7 is a block basic diagram of an exemplary embodiment according to the invention for non-reversible systems, for which the pump is adjusted with a control piston with pressure-regulating valve.

FIG. 7 contains a basic diagram of an exemplary embodiment according to the invention of an adjustment device PV for a non-reversible system, for which the pump 1 is adjusted with the aid of a control piston with a pressure-regulating valve. As shown in FIG. 7, a control piston 9 changes the position of the adjustment member 5 for the pump 1. The control piston 9 is connected via the pump connection 4 to the pressure side of pump 1. If the pressure is 0, a spring 11 moves the adjustment member 5 of pump 1 to maximum displacement volume, thus delivering under pressure a distance-proportional counter force. In case of admittance with pressure, the piston force can be adjusted via an electrically controlled valve 12 for regulating the pressure, e.g., a pressure-regulating valve. The valve is controlled via the control unit Strg. The piston 9 is positioned in connection with the force of spring 11.

Figure 8:
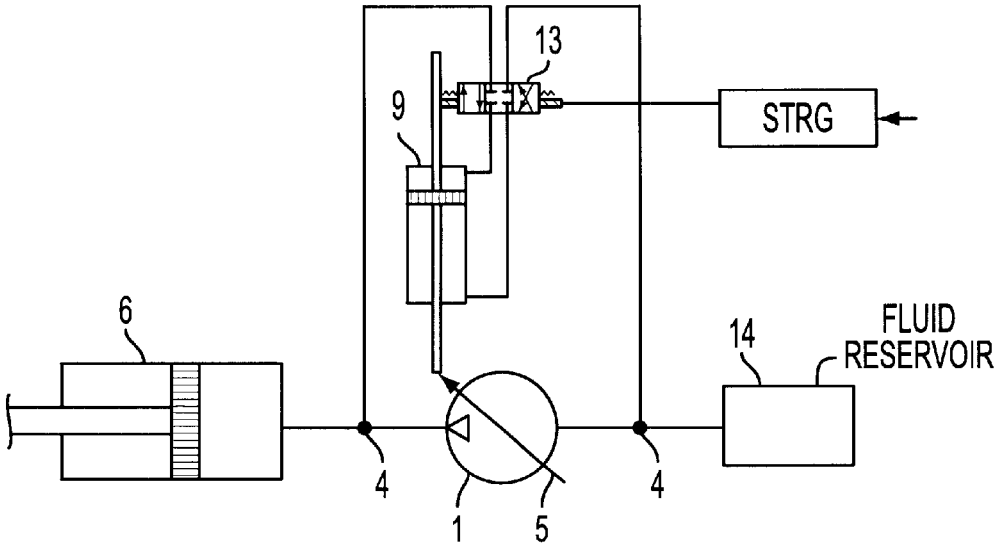
FIG. 8 is a block diagram of an exemplary embodiment according to the invention for non-reversible systems, for which the pump is adjusted with a control piston and an electrically actuated 4/3-way valve.

FIG. 8 contains a basic diagram of a further exemplary embodiment according to the invention of an adjustment device PV for a non-reversible system, for which the pump 1 is adjusted with a control piston and an electrically actuated 4/3-way valve. In this exemplary embodiment, a differential control piston 9 changes the position of adjustment member 5 of pump 1. An electrically controlled 4/3-way valve 13 ensures that the respective piston surface is admitted with pressure. The opening time of valve 13 controls the piston position. The center position of the valve blocks the oil or hydraulic fluid flow and fixes the piston in its position. The control unit Strg controls the valve 13. The adjustment dynamic depends on the level of the pressure gradient between the two load connections 4.

Figure 9:
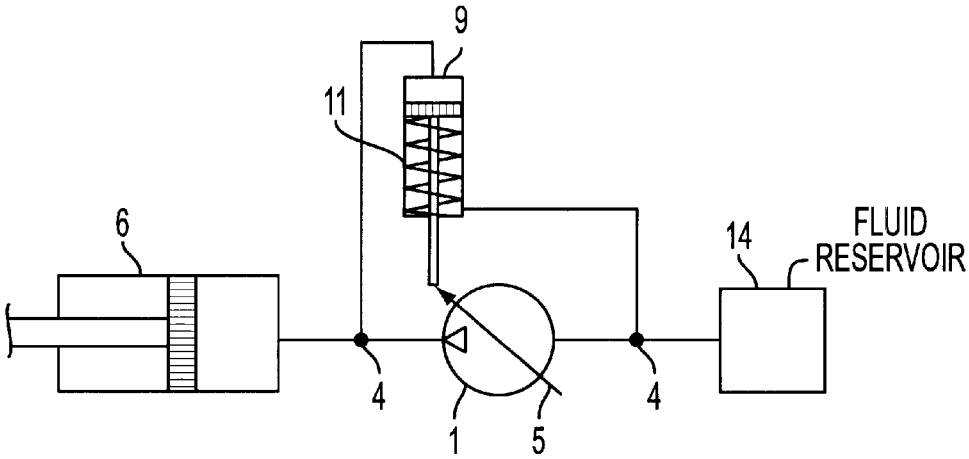
FIG. 9 is a block diagram of an exemplary embodiment according to the invention for non-reversible systems, for which the pump is adjusted with a system-pressure admitted piston with spring.

FIG. 9 shows a basic diagram of another exemplary embodiment according to the invention for a non-reversible system, for which the pump 1 is adjusted by a piston with a spring that is provided with system pressure. In this exemplary embodiment, a control piston 9 changes the position of adjustment member 5 of pump 1. The control piston 9 is connected to the pressure side of pump 1. A spring 11 moves the adjustment member 5 to maximum displacement volume if the pressure is 0 and delivers under pressure a distance-proportional counter force. The movement distance for the variable piston 9 corresponds to the existing pressure gradient. If the spring 11 is installed with pre-stressing, the system control is not activated until a limit pressure gradient $p_{ref}$ is exceeded. The limit pressure gradient $p_{ref}$ is predetermined by the pre-stressing of spring 11. The installation of springs 11 of different lengths and/or different rigidity or the use of differential pistons in the control piston 9 changes the control characteristic. The differential pressure $\Delta p$ between the two connections 4 can be used as control variable since the load moment is approximately proportional to the pressure.

The invention now being fully described, it will be apparent to one of ordinary skill in the art that many changes and modifications can be made thereto without departing from the spirit or scope of the invention as set forth herein.

What is claimed is:

1. An electrohydraulic pressure supply unit comprising:

a speed-controlled electric drive motor (M);

a variable displacement pump (1), for which the displacement volume (V) can be changed with an adjustment member (5), and having connecting lines (3) and load connections (4);

a device (Q) for determining the delivered volume flow ($Q_{actual}$) of the pump;

a regulating device (Reg) for regulating the drive motor (M) speed, with the input variables provided to the regulating device (Reg) including at least the delivered volume flow ($Q_{actual}$) and a desired volume flow ($Q_{desired}$);

a pump adjustment unit (PV) for actuating the adjustment member (5) of the variable displacement pump (1);

a pressure gauge ($\Delta p$) for determining the differential pressure ($\Delta p$) across the load connections, and, a control unit (Strg) for actuating the pump adjustment device (PV), with the control unit (Strg) using at least one reference pressure ($p_{ref}$) and the differential pressure ($\Delta p$) as input variables.

2. A unit according to claim 1, wherein the speed (n) of the drive motor (M) is essentially independent of the adjustment of the displacement volume (V) for variable displacement pump (1).

3. A unit according to claim 1, wherein the variable displacement pump (1) is operated as a device for influencing the torque of the drive motor (M).

4. A unit according to claim 1 for a reversible system wherein: the pump is a reversible pump; a hydraulic actuator (6) and a pressure reservoir (7) are connected to the respective load connections of the pump; and the pump adjustment device (PV) is an electrical actuator (8).

5. A unit according to one of the claims 1 for a reversible system wherein: the pump is a reversible pump; a hydraulic actuator (6) and a pressure reservoir (7), are connected to the respective load connections of the pump; and the pump adjustment device (PV) comprises a control piston (9) for controlling the position of the pump adjustment member and provided with at least one spring (11) which positions the piston to cause maximum displacement volume when the pressure is zero; a hydraulically activated 4/3-way valve (10) connected to the load connections, and to the control piston for always connecting the control piston to the pressure side of the pump; and a regulator valve connected between the 4/3-way valve and the control piston and controlled by the control unit, for regulating the pressure supplied to the control valve.

6. A unit according to claim 1 for a reversible system wherein: the pump is a reversible pump; a hydraulic actuator and a pressure reservoir are connected to respective load connections of the pump; and the pulp adjustment device (PV) comprises a differential control piston for adjusting the position of the adjustment member of the pump; a hydraulically actuated 4/3-way valve having inlets connected to the respective load connections of the pump and outlets connected to the differential piston to supply pressure to opposite surfaces of the differential piston, with the hydraulically actuated valve being responsive to the pressure at the respective load connections for controlling the supply of pressure to the respective sides of the differential piston; and an electrically actuated 4/3-way valve connected between the outlets of the hydraulically actuated valve and inlets of the differential piston, and controlled by said control unit, for regulating the pressure supplied to the differential piston.

7. A unit according to claims 1 for a reversible system wherein: the pump is a reversible pump; a hydraulic actuator (6) and a pressure reservoir (7) are connected to respective load connections of the pump; and the pump adjustment device (PV) comprises a control piston (9) for adjusting the position of the pump adjustment member and is provided with at least one spring which positions the piston to cause maximum displacement volume when the supplied pressure is zero; and one hydraulically actuated 4/3-way valve (10) having inputs connected to the respective load connections and inputs connected across the control piston, with the valve being responsive to the pressure at the load connections to always connect the control piston to the pressure side of the pump.

8. A unit according to claim 1 for a non-reversible system wherein: the pump is a non-reversible pump; a hydraulic actuator (6) and a hydraulic fluid reservoir (14), are connected to the respective load connections of the pump; and the pump adjustment device (PV) is an electrical actuator (8).

9. A unit according to claim 1 for non-reversible systems wherein: the pump is a non-reversible pump; a hydraulic actuator (6) and a hydraulic fluid reservoir (14), are connected to the respective load connections of the pump; and the pump adjustment device (PV) comprises a control piston for adjusting the position of the pump adjustment member with the piston being connected between the load connections of the pump via a control valve for regulating the pressure that is controlled by the control unit, and being provided with at least one spring (11) that positions the piston to cause maximum displacement volume when the supplied pressure is zero.

10. A unit according to claim 1 for a non-reversible system wherein: the pump is a non-reversible pump; a hydraulic actuator and a pressure reservoir are connected to respective load connections of the pump; and the pump adjustment device (PV) comprises a differential control piston for adjusting the position of the adjustment member of the pump, with pressure inlets of the differential piston being connected to the respective load connections of the pump via an electrically actuated 4/3-way valve that causes pressure to be supplied to the proper opposite one of the piston surfaces, and that is controlled by said control unit.

11. A unit according to claim 1 for a non-reversible system wherein: the pump is a non-reversible pump; a hydraulic actuator (6) and a hydraulic fluid reservoir (14) are connected to respective load connections of the pump; and the pump adjustment device (PV) comprises a control piston (9) for adjusting the position of the pump adjustment member, with the piston being connected between the load connections of the pump and responsive to the output of the pump, and being provided with at least one spring that positions the piston to cause maximum displacement volume when the pressure supplied to the piston is zero, that delivers a distance proportional counter force to pressure supplied to the piston, and that is prestressed so as not to permit activation until a predetermined limit pressure preference is exceeded.

* * * * *